United States Patent [19]

Smith

[11] 4,387,478

[45] Jun. 14, 1983

[54] HAND TOOLS

[75] Inventor: Morley L. Smith, Beaconsfield, Canada

[73] Assignee: T. S. Simms & Co. Limited, Saint John, Canada

[21] Appl. No.: 342,783

[22] Filed: Jan. 26, 1982

[51] Int. Cl.[3] ..... B05C 17/02

[52] U.S. Cl. ..... 15/145; 15/146; 15/150; 15/230.11; 16/114 R; 403/61

[58] Field of Search ..... 15/143 R, 145, 146, 15/147 R, 150, 151, 152, 176, 178, 230.11; 16/114 R; 403/61, 330

[56] References Cited

U.S. PATENT DOCUMENTS

| | | | |
|---|---|---|---|
| 1,190,383 | 7/1916 | Court | 403/330 X |
| 1,903,018 | 3/1933 | Wohlhieter | 15/150 X |
| 2,896,240 | 7/1959 | Racine | 15/146 X |
| 4,317,248 | 3/1982 | Smith | 15/145 |

*Primary Examiner*—Edward L. Roberts
*Attorney, Agent, or Firm*—Fetherstonhaugh & Co.

[57] ABSTRACT

An improved implement handle assembly according to the present invention comprises a first and second jaw each having a clamping face adapted to co-operate with one another to releasably engage a mounting member of an implement when in a face-to-face clamping relationship, the first jaw being fast with respect to the handle. The first jaw has a mounting edge extending transversely of the distal end thereof and the second jaw has a locking lip formed at the distal end thereof which is shaped and proportioned to hook around the mounting edge when the jaws are in the clamping position to lock the jaws closed. The second jaw has its proximal end both pivotally and slidably mounted with respect to said handle whereby said first jaw may slide between an extended and a retracted position and may pivot between an open position and a clamping position with respect to the first jaw such that, when said second jaw is in the retracted and clamping position the locking lip is hooked around the mounting edge to prevent pivotal movement of the second jaw and the second jaw is free to pivot between said clamping position and said open position when the second is in the extended position.

2 Claims, 4 Drawing Figures

HAND TOOLS

Figure 1:
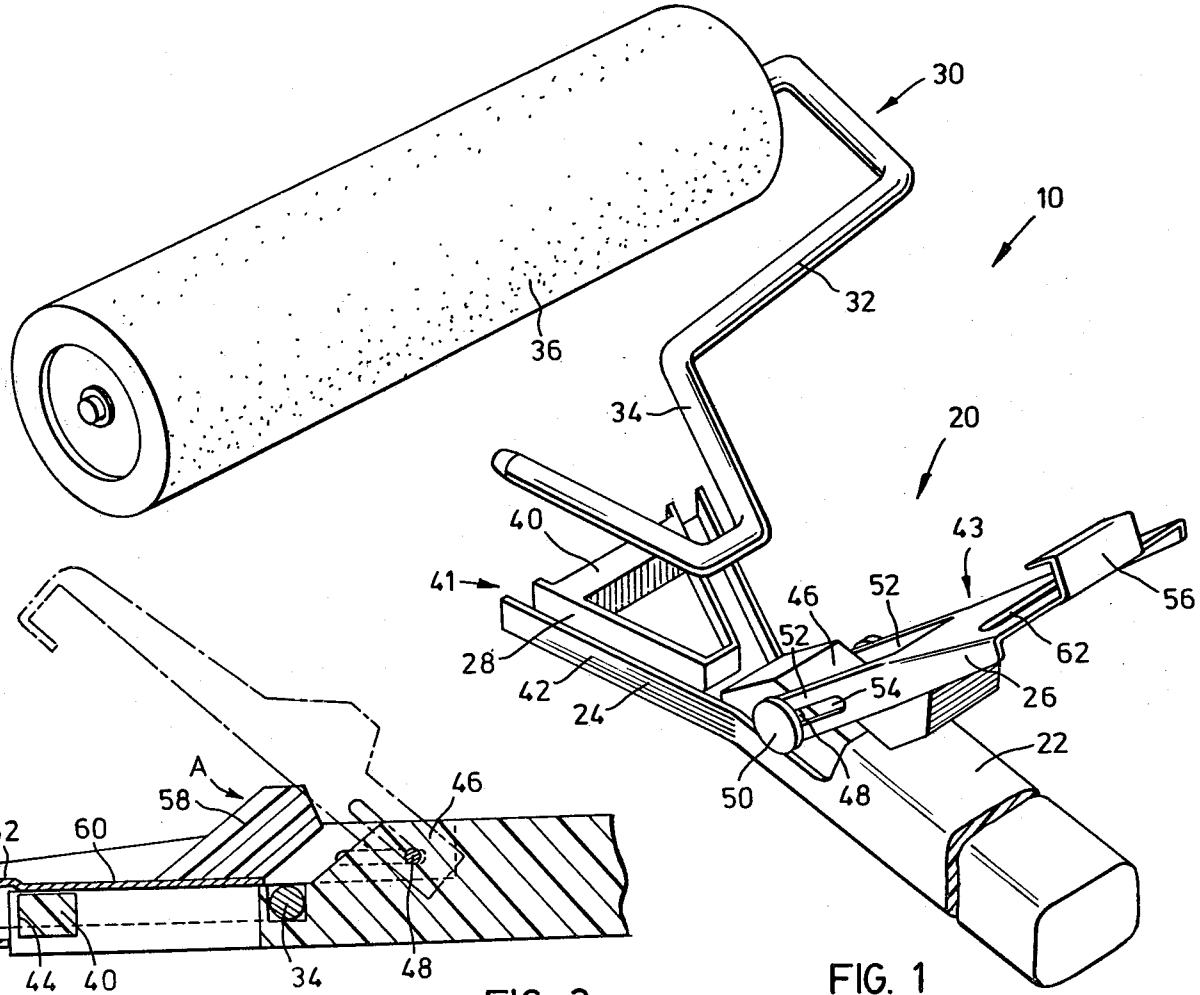

This invention relates to improvements in an implement handle. In particular this invention relates to an improved clamping jaw assembly for releasably clamping an implement to a handle.

RELATED APPLICATIONS

The clamping jaw assembly of the present invention is suitable for use in association with a hand tool assembly of the type disclosed in my prior U.S. application Ser. No. 242,291 now U.S. Pat. No. 4,317,248 which is a continuation-in-part of Ser. No. 970,383 filed Dec. 18, 1978 the specification of which is incorporated herein by reference.

PRIOR ART

In my prior clamping jaw assembly I provided a seperate clamping member for use in releasably securing the two jaws in the clamping position. The use of a seperate jaw requires a two hand manipulation of the assembly to lock and release the jaws and this can create difficulties when attempting to remove an implement, such as a wet paint roller, which must be manually supported during removal.

It is an object of the present invention to provide an improved clamping jaw assembly which can be manipulated between an open and a closed position by a one handed operation.

A further disadvantage of the structure of my prior assembly is that the clamping device was detachable from the jaws and could be lost or misplaced during storage or use.

It is a further object of the present invention to provide an improved clamping jaw assembly in which the clamping jaws can be releasably locked with respect to one another without the aid of a seperate clamping member.

SUMMARY OF INVENTION

According to one aspect of the present invention there is provided in an implement handle assembly having a handle portion and first and second jaws each having a clamping face adapted to co-operate with one another to releasably engage a mounting member of an implement when in a face-to-face clamping position, said first jaw being fast with respect to said handle, the improvement wherein; said first jaw has a mounting edge extending transversly of the distal end thereof, and said second jaw has a locking lip formed at the distal end thereof, said lip being shaped and proportioned to hook around said mounting edge when said jaws are in said clamping position to lock said jaws in clamping position, and wherein said second jaw has its proximal end both pivotally and slidably mounted with respect to said handle whereby said first jaw may slide between an extended position and a retracted position and may pivot between an open position and said clamping position with respect to said first jaw such that when said second jaw is in said retracted and clamping positions said locking lip is hooked around said mounting edge to prevent pivotal movement of said first jaw, and when said second jaw is in said extended position and second jaw is free to pivot between said clamping position and said open position.

PREFERRED EMBODIMENT

Figure 3:
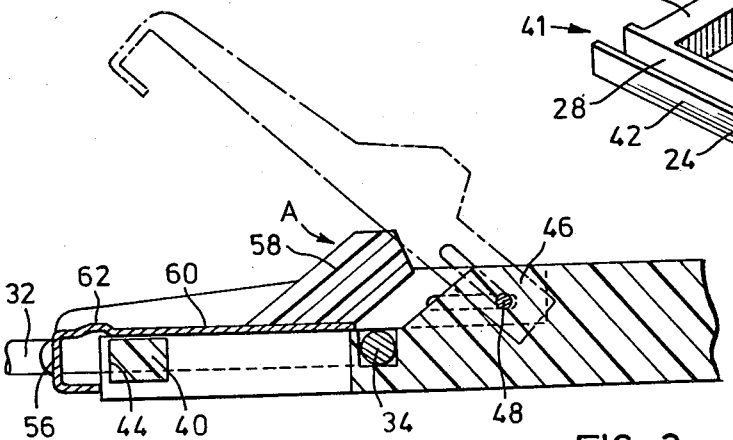
Figures 2, 4:
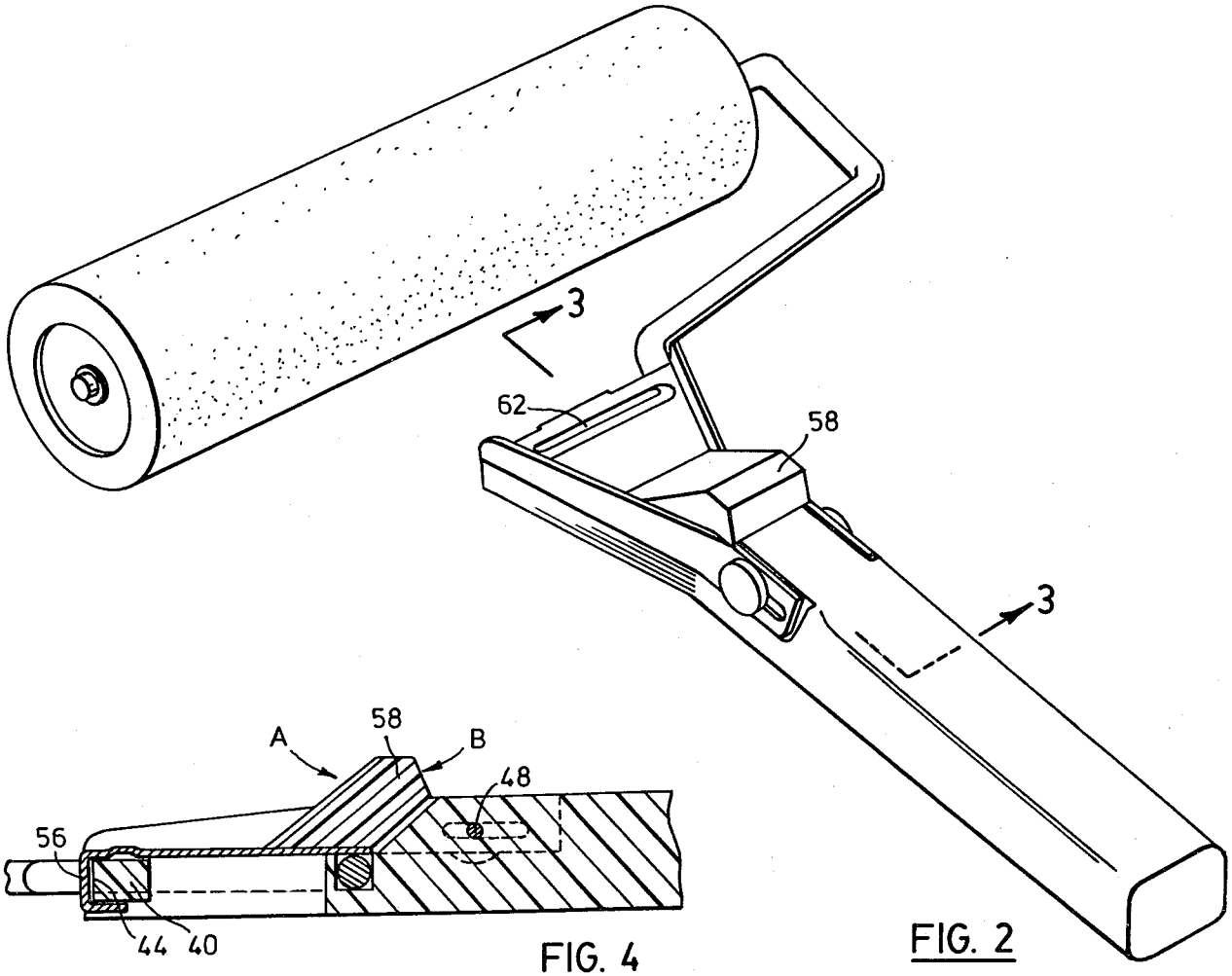

The invention will be more clearly understood with reference to the following detailed specification in conjunction with the drawings wherein;

FIG. 1 is a pictorial plan view of a handle assembly constructed according to an embodiment of the present invention, FIG. 2 is a view similar to FIG. 1 showing the clamping jaws in a closed position, FIG. 3 is a sectional side view taken along the line 3—3 of FIG. 2 showing the first two steps in the clamping procedure, FIG. 4 is a view similar to FIG. 3 showing the jaws in the locked position.

With reference to FIG. 1 of the drawings, the reference numeral 10 refers generally to a modular hand-tool of the type described in my copending application Ser. No. 242,291 which includes a handle assembly generally identified by the reference numeral 20 and a paint roller assembly generally identified by the reference numeral 30. The paint roller assembly comprises a roller frame assembly 32 which has a generally V-shaped coupling component 34 at one end thereof and a roller coater 36 mounted for rotation at the other end thereof. The structure of the roller assembly 30 may be substantially the same as that described in copending application Ser. No. 242,291 and will not therefore be described in detail.

The handle assembly 20 comprises a manually engageable handle portion 22 upon which a first jaw 24 is rigidly mounted and a second jaw 26 is pivotally mounted. The first jaw 24 has a pair of arms 42 within which a U-shaped channel 28 is formed. The U-shaped channel 28 extends along a generally V-shaped path corresponding to the configuration of the coupling member 34 of the roller frame. A bridge member 40 extends transversely between the distal ends of the arms 32. The bridge member 40 has a mounting edge 44 (FIGS. 3 and 4) upon which the second jaw is locked as will be described hereafter.

A shoulder 46 is formed at the distal end of the end portion 22 and a pivot pin 48 is mounted to project laterally from the shoulder 46 on opposite sides thereof. An enlarged head portion 50 is located at each end of the pivot pin 48.

The proximal end of the second jaw 26 is bifurcated to provide a pair of arms 52 each of which is formed with an elongated passage 54 which receives the pivot pin 48. A hook shaped lip 56 is located at the distal end of the second jaw 26 and is proportioned to fit in a close fitting relationship about the mounting edge 44 of the bridge member 40. A thumb-pad 58 is mounted on the upper face 60 of the second jaw 26 so as to be engageable by the thumb of the user when the handle portion 22 is in the grasp of the user. A stiffening ridge 62 extends transversely of the distal end of the second jaw 24.

The reference numeral 41 refers generally to the clamping face of the first jaw 24 and the reference numeral 43 refers generally to the clamping face of the second jaw 26.

The first jaw 24 is fast with respect to the handle portion 22 and the second jaw 26 is both pivotally and slidably mounted on the pivot pin 48 for movement between an extended open position as shown in FIG. 1 and a retracted closed position as shown in FIGS. 2 and 4.

In use, the second jaw 26 is positioned as shown in FIG. 1 of the drawings so as to permit the coupling element 34 to be seated in the channel 28. The second jaw 26 is, then, pivoted to the closed position shown in FIG. 3 of the drawings. This can be achieved by the user merely pushing the thumb pad 58 with the thumb of the hand which is used to grasp the handle 22. Thereafter, the second jaw 26 is moved to the retracted position shown in FIG. 3 and, again, this can be achieved by the application of a load in the direction of the arrow A indicated in FIG. 3 and such a load can be applied by the thumb of the hand used to grasp the handle portion 22. This causes the jaw 26 to slide along the pivot pin 48 to position the locking lip 56 over the locking edge 44, the locking lip 56 being proportioned to provide a tight fit over the locking edge 44 so that it will not be accidentally dislodged in use.

The second jaw 26 can be released in order to permit it to return to the open position by the application of a load applied to the thumb pad 58 in the direction of the arrow B which can be applied by the thumb of the hand used to grasp the handle portion 22.

From the foregoing, it will be apparent that the implement handle assembly of the present invention provides a simple and efficient clamping jaw which facilitates the mounting and removal of an implement. It will be apparent that other implements having a coupler element corresponding to the coupler element 34 may be mounted in the handle assembly of the present invention. Other implements may include sanding pads, scrapers or the like.

What I claim as my invention is:

1. In an implement handle assembly having a handle portion and first and second jaws each having a clamping face adapted to co-operate with one another to releasably engage a mounting member of an implement when disposed in a face-to-face clamping position, said first jaw being fast with respect to said handle, the improvement wherein:

(a) said first jaw has a mounting edge extending transversely of the distal end thereof, and (b) said second jaw has a locking lip formed at the distal end thereof, said locking lip being shaped and proportion to hook around said mounting edge when said jaws are in said clamping position to lock said jaws in said clamping position, and (c) said second jaw has its proximal end both pivotally and slidably mounted with respect to said handle whereby said first jaw may slide between an extended position and a retracted position and may pivot between an open position and said clamping position with respect to said first jaw such that, when said second jaw is in said retracted and clamping positions, said locking lip is hooked around said mounting edge to prevent pivotal movement of said second jaw and when said second jaw is in said extended position, said second jaw is free to pivot between said clamping position and said open position.

2. An implement handle assembly, as claimed in claim 1, further comprising a thumb pad mounted on said second jaw and positioned to be accessible to the thumb of a hand grasping said handle portion whereby sliding movement of said second jaw may be achieved by the application of thumb-applied loads to the second jaw.

* * * * *